US010182699B2

(12) United States Patent
Lee et al.

(10) Patent No.: US 10,182,699 B2
(45) Date of Patent: Jan. 22, 2019

(54) DISHWASHER

(71) Applicant: Samsung Electronics Co., Ltd., Suwon-si (KR)

(72) Inventors: Jee-Hoon Lee, Seoul (KR); Ji Won Ryu, Yongin-si (KR); Jea Won Lee, Hwaseong-si (KR); Hyung Kwen Ham, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/050,688

(22) Filed: Feb. 23, 2016

(65) Prior Publication Data

US 2016/0338568 A1 Nov. 24, 2016

(30) Foreign Application Priority Data

Feb. 26, 2015 (KR) ..... 10-2015-0027200

(51) Int. Cl.

*A47L 15/28* (2006.01)
*A47L 15/00* (2006.01)
*A47L 15/48* (2006.01)

(Continued)

(52) U.S. Cl.

CPC ..... *A47L 15/28* (2013.01); *A47L 15/0028* (2013.01); *A47L 15/0034* (2013.01);

(Continued)

(58) Field of Classification Search

None

See application file for complete search history.

(56) References Cited

U.S. PATENT DOCUMENTS 1,755,539 A * 4/1930 Gerosa ..... A47L 15/33 134/105
3,002,731 A * 10/1961 Gelfand ..... A47L 15/13 134/1

(Continued)

FOREIGN PATENT DOCUMENTS

CN 1931081 3/2007
CN 201481362 5/2010

(Continued)

OTHER PUBLICATIONS

Extended European Search Report dated Jul. 11, 2016 from European Patent Application No. 16156962.9, 10 pages.

(Continued)

*Primary Examiner* — Michael E Barr
*Assistant Examiner* — Cristi J Tate-Sims
(74) *Attorney, Agent, or Firm* — Staas & Halsey LLP

(57) ABSTRACT

A washing operation and a drying operation are performed while a basket which is located inside a washing tub and accommodates dishes reciprocates in a vertical direction of a washing tub due to a driving device. The basket reciprocates in order to pass through an injection nozzle which injects washing water and an air nozzle which injects air to perform the washing operation while passing through the injection nozzle and to perform the drying operation while passing through the air nozzle. Through this, a small amount of dishes may be washed and dried in a short time and the dishes may be washed using a small amount of water and energy.

18 Claims, 14 Drawing Sheets

(51) Int. Cl.
*A47L 15/50* (2006.01)
*A47L 15/42* (2006.01)

(52) U.S. Cl.
CPC ..... *A47L 15/0089* (2013.01); *A47L 15/486* (2013.01); *A47L 15/504* (2013.01); *A47L 15/4257* (2013.01); *A47L 2401/34* (2013.01); *A47L 2501/12* (2013.01); *A47L 2501/20* (2013.01)

(56) References Cited

U.S. PATENT DOCUMENTS 6,026,831 A * 2/2000 Jarvis ..... A47L 15/0092 134/127
6,379,042 B1 * 4/2002 Polkus ..... A61B 6/105 318/466
2005/0072449 A1 * 4/2005 Alpert ..... A47L 15/0002 134/25.1
2010/0012163 A1 1/2010 Alpert et al.
2013/0233355 A1 * 9/2013 Alpert ..... A47K 10/48 134/30

FOREIGN PATENT DOCUMENTS

CN 203029179 7/2013
JP 6-189888 7/1994

OTHER PUBLICATIONS

European Office Action dated Apr. 7, 2017 in European Patent Application No. 16156962.9.

* cited by examiner

DISHWASHER

CROSS-REFERENCE TO RELATED APPLICATIONS

This application claims the priority benefit of Korean Patent Application No. 10-2015-0027200, filed on Feb. 26, 2015 in the Korean Intellectual Property Office, the disclosure of which is incorporated herein by reference.

BACKGROUND

1. Field

The following description relates to a dishwasher which washes a small amount of dishes.

2. Description of the Related Art

A dishwasher is a home appliance which includes a body provided with a washing tub, a basket which accommodates dishes, a sump which stores washing water, an injection nozzle which injects the washing water, and a pump which supplies the washing water in the sump to the injection nozzle and washes the dishes by injecting the washing water at high pressure to the dishes.

Generally, in a dishwasher, a plurality of dishes are put on the basket fixed to and supported by the washing tub, a rotor type injection structure having an injection nozzle which rotates is provided, and a rotating nozzle which injects washing water while rotating due to water pressure and thereby performs a washing operation. Such a conventional dishwasher washes a large amount of the dishes at once and accordingly has a large volume and takes a relatively long time. Also, because the washing water is injected within a range of a radius of rotation of the rotating nozzle, a plurality of such rotating nozzles are arranged to have various wide radiuses of rotation and water consumption is increased. Accordingly, in a case of a single-person household, because a small amount of dishes are washed, when a conventional dishwasher is used, energy and water may be wasted and a long washing time is taken compared with a dish amount.

SUMMARY

Therefore, it is an aspect of the present disclosure to provide a dishwasher appropriate for washing a small amount of dishes.

It is an aspect of the present disclosure to provide a dishwasher in which a washing operation is performed by a reciprocating movement of a basket.

Additional aspects of the disclosure will be set forth in part in the description which follows and, in part, will be obvious from the description, or may be learned by practice of the disclosure.

In accordance with an aspect of the present disclosure, a dishwasher includes a body which has an opening, a washing tub provided inside the body, an injection nozzle located inside the washing tub to inject washing water to dishes, an air nozzle provided at one side of the washing tub to inject air to the dishes, and a basket which accommodates the dishes therein and is provided to reciprocate in the washing tub due to a driving device.

The injection nozzle may include a plurality of injection nozzle arms which include injection holes through which the washing water is injected. Here, at least one pair of the plurality of injection nozzle arms may be disposed at a predetermined interval to be parallel to each other to allow the injection holes to face each other. Also, the basket may reciprocate between the one pair of injection nozzle arms disposed parallel to each other.

The air nozzle may include a plurality of air injection nozzle arms which include air injection holes through which the air is injected. Here, at least one pair of the plurality of air injection nozzle arms may be disposed at a predetermined interval to be parallel to each other to allow the air injection holes to face each other. Also, the basket may reciprocate between the one pair of air injection nozzle arms disposed parallel to each other.

The driving device may be provided between the one pair of injection nozzle arms and the one pair of air injection nozzle arms and may be configured to have a long side in a vertical direction of the body.

The basket may be supported by a top end of the driving device and may reciprocate to a bottom end of the driving device while being connected to the driving device.

The basket may move downward to the bottom end of the driving device when the injection nozzle injects the washing water.

The basket may move upward from the bottom end of the driving device to the top end of the driving device when the air nozzle injects the air.

The basket may reciprocate at least once while being connected to the driving device when the injection nozzle injects the washing water.

The basket may reciprocate at least once while being connected to the driving device when the air nozzle injects the air.

The air nozzle may inject the air to pressurize and remove humidity which remains on surfaces of the dishes using air pressure.

An air blower which supplies the air to the air nozzle may be provided in the body.

The air nozzle may include a supply pipe provided to receive the air supplied by the air blower, and one or more bent portions may be provided in a part of the supply pipe to be adjacent to an outside of the washing tub.

The driving device may include a motor which generates a driving force, a belt which is connected to a driving pulley and an idle pulley and rotates to transfer the driving force of the motor to the basket, and a rail which guides a movement of the basket.

The rail may have a pipe shape which has an internal space and an opening at one side thereof.

The belt may be disposed in the internal space of the rail, and the driving device may further include a belt holder which is coupled to a tooth form of the belt and moves together with the belt in the internal space of the rail.

The driving device may further include a basket holder which is provided to surround an outer surface of the rail, moves together with the belt holder while being coupled to the belt holder through the opening of the rail, and coupled with the basket.

In accordance with an aspect of the present disclosure, a dishwasher includes a body, a washing tub provided inside the body, a basket provided to accommodate dishes in the washing tub, an injection nozzle provided in the washing tub to inject washing water to the dishes, a driving device which drives the basket to pass through the injection nozzle and reciprocate while the injection nozzle is driven to allow the dishes stored in the basket to be washed.

The injection nozzle may include at least one pair of injection nozzle arms which include injection holes through which the washing water is injected. Here, the at least one pair of injection nozzle arms may be disposed at a predetermined interval to be parallel to each other to allow the injection holes to face each other. Also, the driving device may be disposed between the one pair of injection nozzle arms.

The dishwasher may further include an air nozzle which injects air to pressurize and remove humidity which remains on surfaces of the dishes using air pressure.

The air nozzle may include at least one pair of air nozzle arms which include air injection holes through which the air is injected, in which the at least one pair of air nozzle arms are disposed at a predetermined interval to be parallel to each other to allow the air injection holes to face each other. Here, the driving device may be disposed between the one pair of air nozzle arms.

An opening may be provided at one side of the washing tub. Also, when the dishes inserted through the opening are accommodated in the basket and moved to the other side of the washing tub, the injection nozzle may be operated to wash the dishes.

When the basket which moved to the other side of the washing tub moves toward the opening of the washing tub, the air nozzle may be operated to dry the dishes.

The driving device may include a motor which generates a driving force, a belt which is connected to a driving pulley and an idle pulley and rotates to transfer the driving force of the motor to the basket, and a rail which guides a movement of the basket.

In accordance with an aspect of the present disclosure, a dishwasher includes a body, a washing tub which is provided inside the body and includes an opening on a top thereof, an injection nozzle fixed to an inside of the washing tub to inject washing water to dishes, an air nozzle fixed to one side of the washing tub to inject air to the dishes, a basket which accommodates the dishes to allow the dishes to reciprocate between the fixed injection nozzle and air nozzle, and a motor which drives the basket. Here, the basket reciprocates depending on a driving of the injection nozzle and air nozzle.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
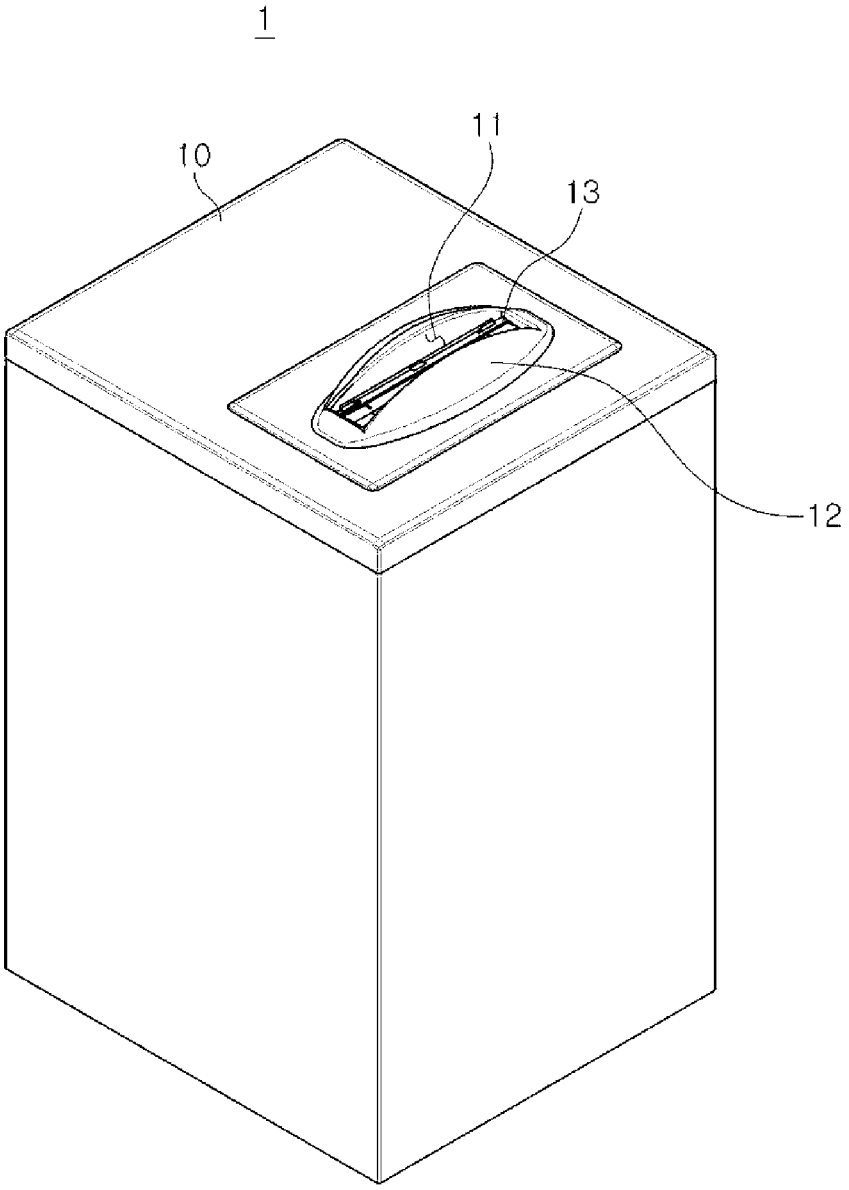
FIG. 1 is a perspective view of a dishwasher in accordance with an embodiment of the present disclosure.

Reference will now be made in detail to the embodiments of the present disclosure, examples of which are illustrated in the accompanying drawings, wherein like reference numerals refer to like elements throughout.

Hereinafter, embodiments of the present disclosure will be described in detail with reference to the attached drawings.

Figure 2A:
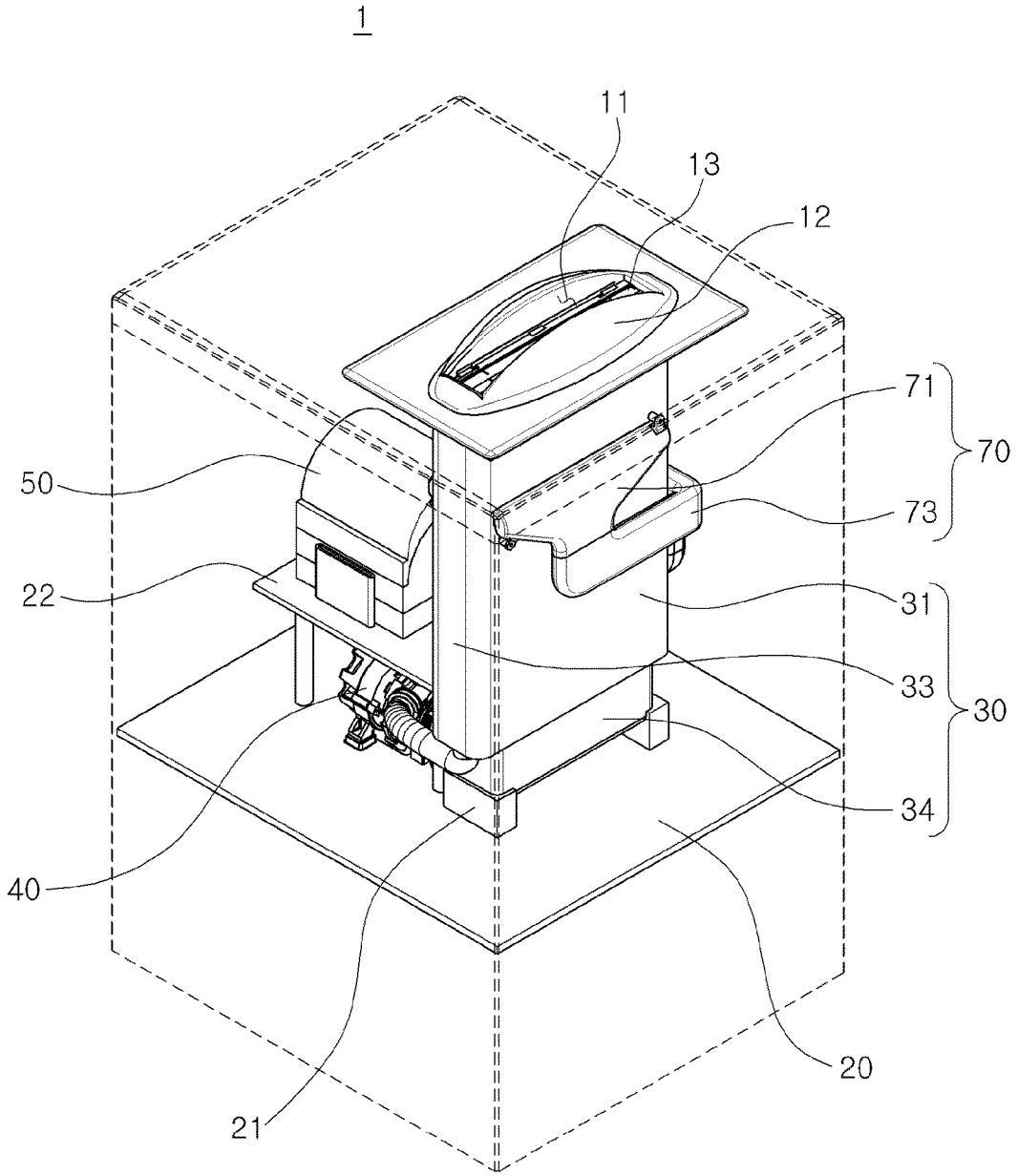
FIG. 2A is a perspective view illustrating a state in which a body of the dishwasher in accordance with an embodiment of the present disclosure is removed.
Figure 2B:
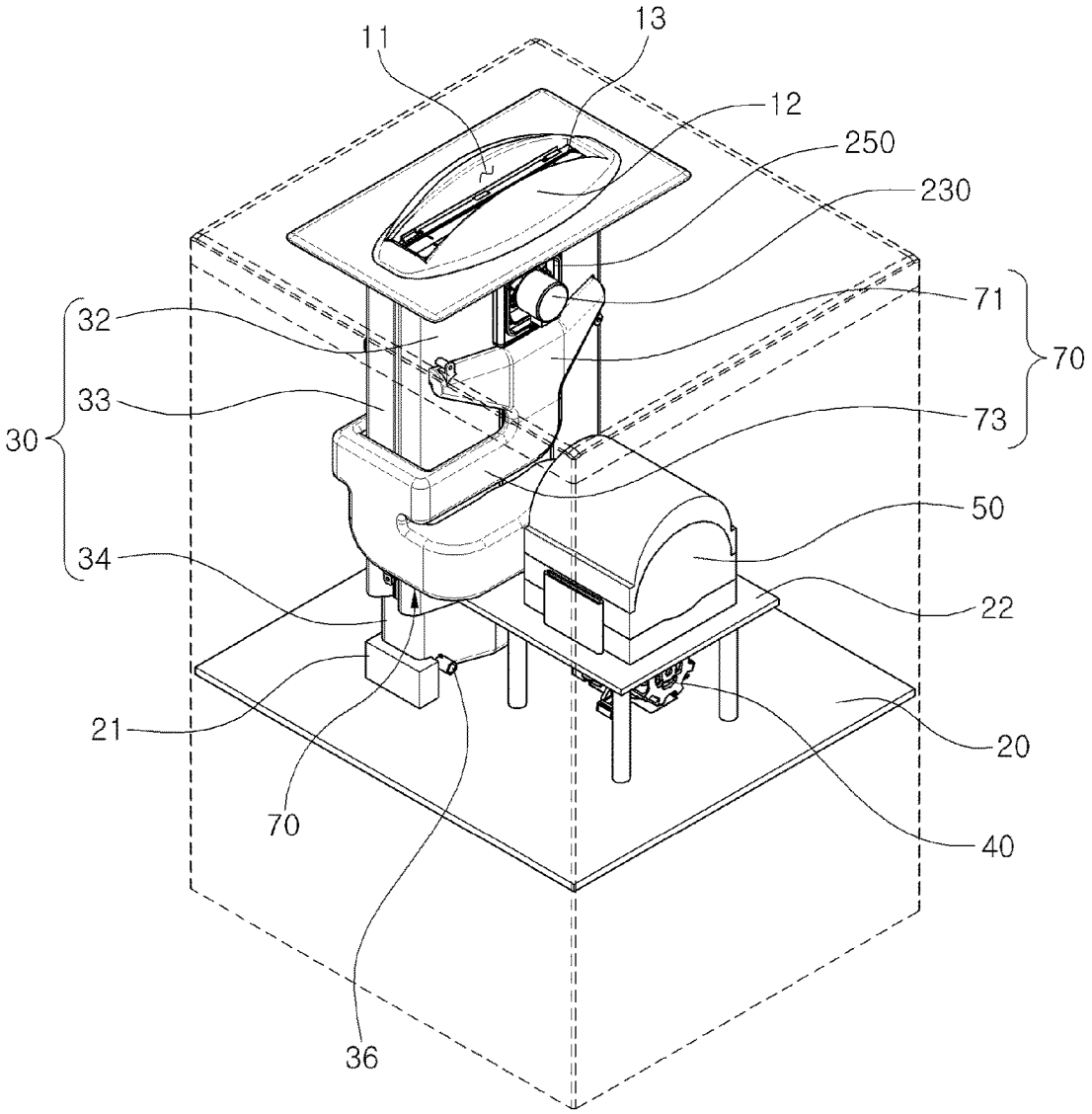
FIG. 2B is a perspective view illustrating the state in which the body of the dishwasher in accordance with an embodiment of the present disclosure is removed.
Figure 3:
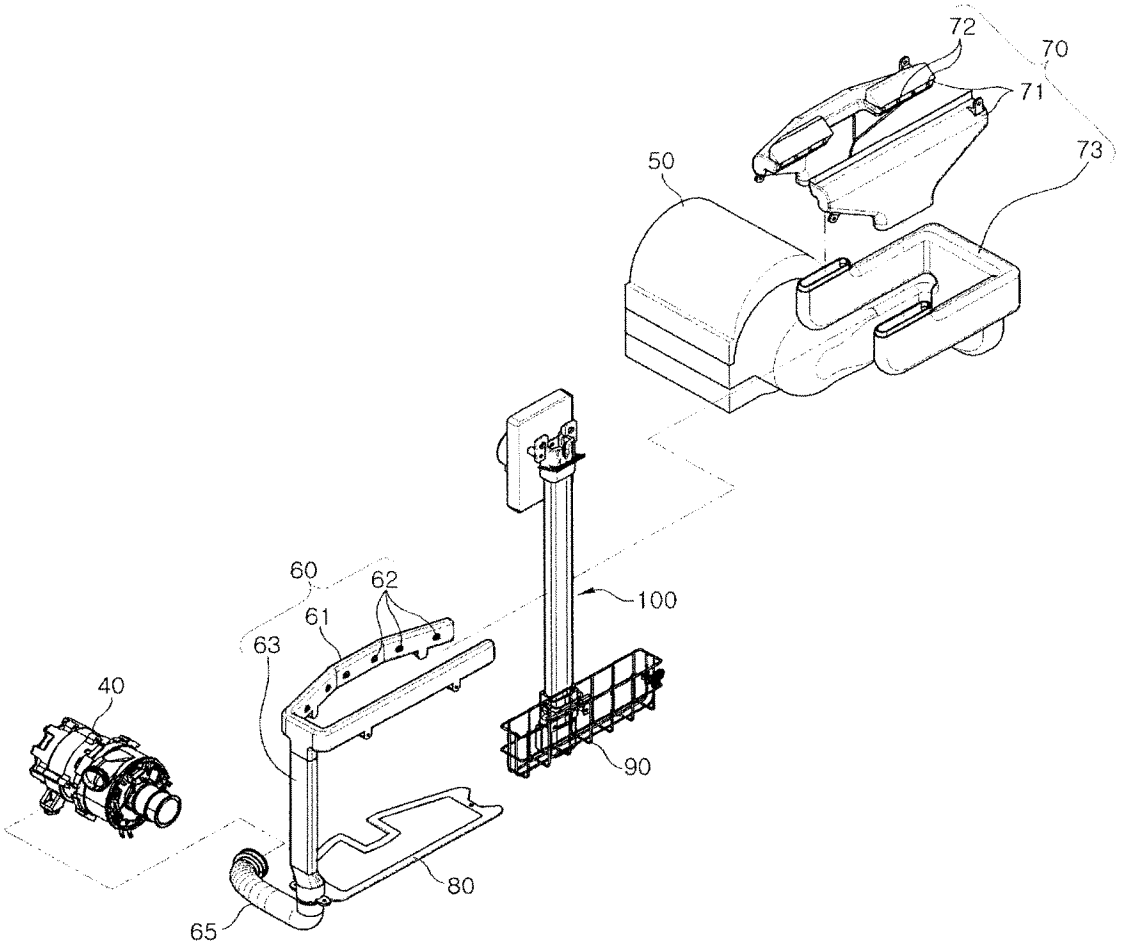
FIG. 3 is an exploded perspective view illustrating some components in a state in which a washing tub of the dishwasher in accordance with an embodiment of the present disclosure is removed.

As shown in FIGS. 1 to 3, a dishwasher 1 may include a body 10 which forms an exterior and a washing tub 30 provided inside the body 10.

The body 10 may include an opening 11 through which dishes may be inserted in a top portion thereof. A dish guide 12 which guides the dishes inserted into the opening 11 may be provided on both sides of the opening 11.

A cover 13 which opens and closes the opening 11 when the dishes move down into the washing tub 30 may be provided at the opening 11.

The cover 13 includes two plates provided in parallel and disposed to maintain a closed state of the opening 11, and which may be pivotable in a vertical direction by an elastic member (not shown) provided at a portion in which the plates and the both sides of the opening 11 contact when pressurized by the dishes to be able to return to a position which maintains the closed state due to an elastic force.

The washing tub 30 may have an approximate box shape with an open top portion corresponding to the top portion at which the opening 11 is provided so the dishes may be inserted or withdrawn.

The washing tub 30 includes a front wall 31 which has a short side in a longitudinal direction of the dishes and a long side in a vertical direction of the body 10, a rear wall 32, and two sidewalls 33 which connect the front wall 31 and the rear wall 32 as sides.

A washing tub bottom 34 with an inner area gradually reduced inward is provided at bottom ends of the front and rear walls 31 and 32 and the sidewalls 33. A sump (not shown) which stores washing water collected to a bottom end of the washing tub 30 due to a washing operation and a drying operation for the dishes and connected to a pump 40 may be provided at the washing tub bottom 34, which will be described below.

The washing tub bottom 34 may have an external surface corresponding to a size of the sump. Accordingly, the external surface is not limited to the embodiment of the present disclosure, and the washing tub bottom 34 may have an outside which is extended further than the walls 31, 32, and 33 of the washing tub 30.

The washing tub 30 is disposed on a base panel 20 provided inside the body 10. The base panel 20 has a plate shape parallel to top and bottom surfaces of the body 10, and may support a bottom of the washing tub 30 to allow a top of the washing tub 30 to correspond to the opening 11.

Accordingly, a position of the base panel 20 disposed in the body 10 may change depending on a size of the body 10. That is, when the body 10 is formed in a built-in type, the body 10 is not limited to a size of the washing tub 30 but may be provided corresponding to a height or an area of a built-in component disposed on a side of the body 10.

The base panel 20 may include a washing tub support member 21 for fixing the washing tub 30. The washing tub 30 may be mounted on the washing tub support member 21 and supported by the base panel 20, to prevent noise by preventing vibrations generated in the washing tub 30 from being directly transferred to the base panel 20.

The pump 40 may be disposed on the base panel 20. The pump 40 may supply washing water injected in an injection nozzle 60.

The washing water injected by the injection nozzle 60 is stored in the washing tub bottom 34 in the washing tub 30. A cycle where the stored washing water is moved again to the injection nozzle 60 at a constant pressure by the pump 40 pumping to be injected again may occur.

The washing water pumped by the pump 40 may be transferred to the injection nozzle 60 located inside the washing tub 30 through a supply hose 65 provided outside the washing tub 30.

The washing water injected by the injection nozzle 60 may be used to wash the dishes stored in the washing tub 30.

The washing water stored in the washing tub 30 and waste may be discharged into the washing tub 30 through a drainage hole 36 and may be discharged outside the body 10 through a drain (not shown). Here, a drainage pump (not shown) may be additionally provided as necessary to efficiently perform a drainage operation.

A second base panel 22 may be provided above the base panel 20 and an air blower 50 may be provided above the second base panel 22.

The air blower 50 is not limited to the embodiment of the present disclosure but may be disposed on the base panel 20. A position of the air blower 50 may vary according to the size of the body 10.

A fan provided inside the air blower 50 rotates and a central portion of the fan becomes a vacuum while rotating, thereby discharging air at a high pressure generated by a difference in pressure through an air nozzle 70.

The high pressure air injected by the air nozzle 70 may remove moisture which remains on surfaces of the dishes to the outside of the dishes through the pressure of the air. That is, the moisture which remains on the dishes may be removed through a physical effect of the air.

The air generated by the air blower 50 is external air which flows into the body 10, and air corresponding to a temperature inside the body 10 may be injected. However, the air is heated using heat generated by a motor provided inside the air blower 50 to rotate the fan of the air blower 50 to inject the air at a higher temperature than that of the inside of the body 10.

Here, a housing which includes a material with an excellent insulation function may be further provided outside the motor to store the heat generated by the motor.

The air nozzle 70 may include a supply pipe 73 which transfers the high pressure air formed by the air blower 50 and an air nozzle arm 71 which injects the air transferred through the supply pipe 73.

A pair of such air nozzle arms 71 may be provided and may be located on the front wall 31 and the rear wall 32 of the washing tub 30, respectively. The front wall 31 and the rear wall 32 may include through holes to allow parts of the air nozzle arms 71 to pass through the washing tub 30.

The supply pipe 73 may be formed along a circumference of an outer surface of the washing tub 30. That is, a part of the supply pipe 73 may have a bracket shape corresponding to the outer surface of the washing tub 30 which has the box shape. For this, the supply pipe 73 may have at least one bent portion.

The supply pipe 73 may be disposed adjacently to the washing tub 30 to reduce an area occupied by internal components in the body 10.

Hereinafter, operations of the dishwasher 1 will be described. The dishwasher 1 may have a water supply operation, a washing operation, a drainage operation, and a drying operation.

During the water supply operation, washing water may be supplied into the washing tub 30 through a water supply pipe (not shown). The washing water supplied to the washing tub 30 may flow into and be stored in the sump provided at the washing tub bottom 34. During the washing operation, the pump 40 may be operated to pump the washing water in the sump. The washing water pumped by the pump 40 may be supplied to the injection nozzle 60 through the supply hose 65. Due to a pumping force of the circulation pump 40, the washing water may be injected from injection holes 62 provided in the injection nozzle 60 at high pressure, thereby washing the dishes.

The washing water injected from the injection nozzle 60 may hit the dishes to remove waste on the dishes, and may drop together with the waste to be collected in the sump again. The pump 40 pumps the washing water again to circulate the washing water. During the washing operation, the pump 40 may repeatedly operate and stop several times. During this process, the waste which drops together with the washing water to the washing tub bottom 34 is collected by a filter 80 mounted above the washing tub bottom 34 and remains in the sump instead of circulating through the injection nozzle 60.

During the drainage operation, the drainage pump may operate to discharge the washing water together with the waste which remains in the sump from the body 10.

During the drying operation, the air blower 50 mounted in the washing tub 30 operates and the high pressure air is supplied to the air nozzle 70, thereby allowing the high pressure air to be injected through air injection holes 72 to dry the dishes.

Hereinafter, main components for the washing operation and the drainage operation of the dishwasher 1 in accordance with an embodiment of the present disclosure will be described in detail.

As shown in FIGS. 3 to 5B, a basket 90 which stores the dishes, the injection nozzle 60 which injects the washing water to the dishes to wash the dishes, the air nozzle 70 which injects air to the dishes to dry the dishes, and a driving device, or basket driver, 100 which drives the basket 90 to allow the dishes to reciprocate between the injection nozzle 60 and the air nozzle 70, are provided in the washing tub 30.

The basket 90 may be a wire rack formed of wires to allow the washing water to pass therethrough and not be collected in a space which stores the dishes.

Figure 4A:
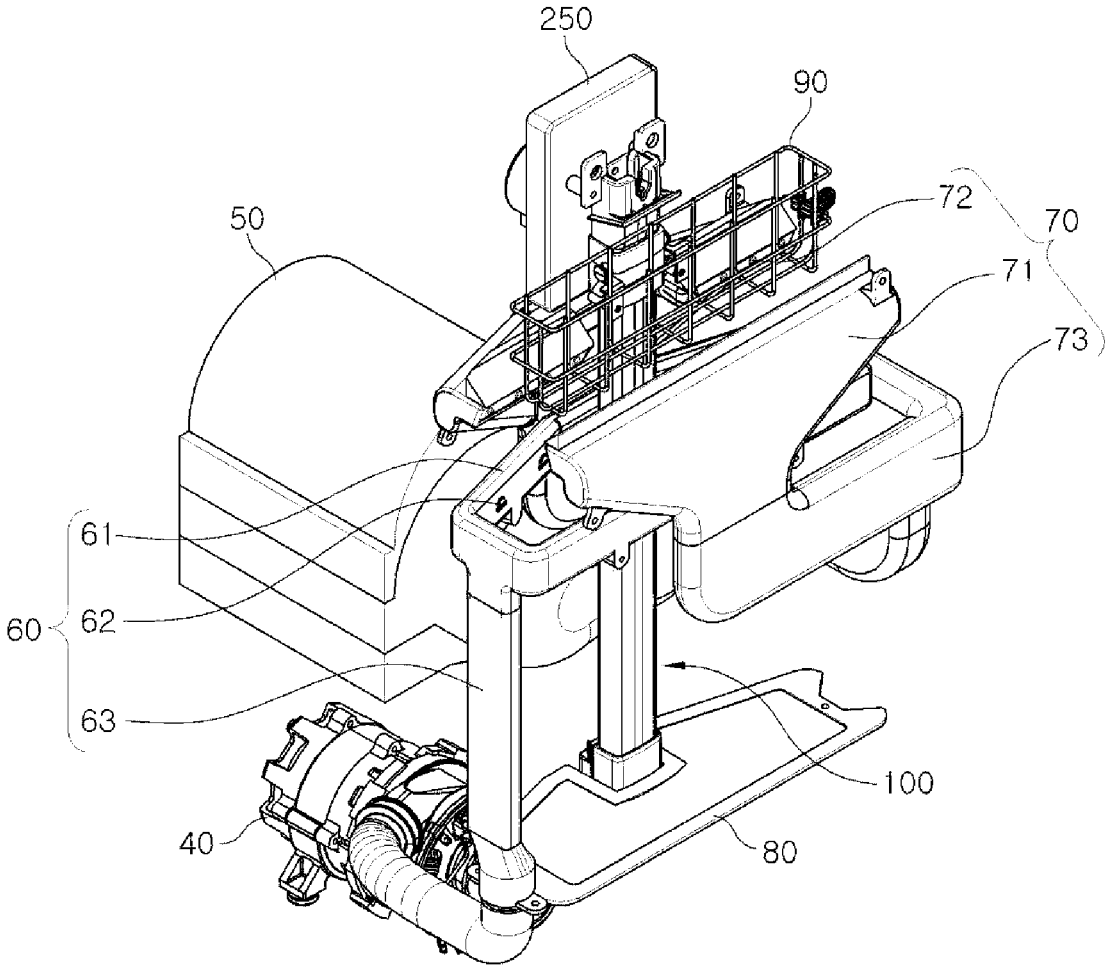
FIG. 4A is a perspective view illustrating a state in which a basket is located above while the washing tub of the dishwasher in accordance with an embodiment of the present disclosure is removed.

When the dishwasher 1 stops, the basket 90 may be provided above the washing tub 30 as shown in FIG. 4A. This is to allow a user to place the dishes in the basket 90 through the opening 11.

Figure 4B:
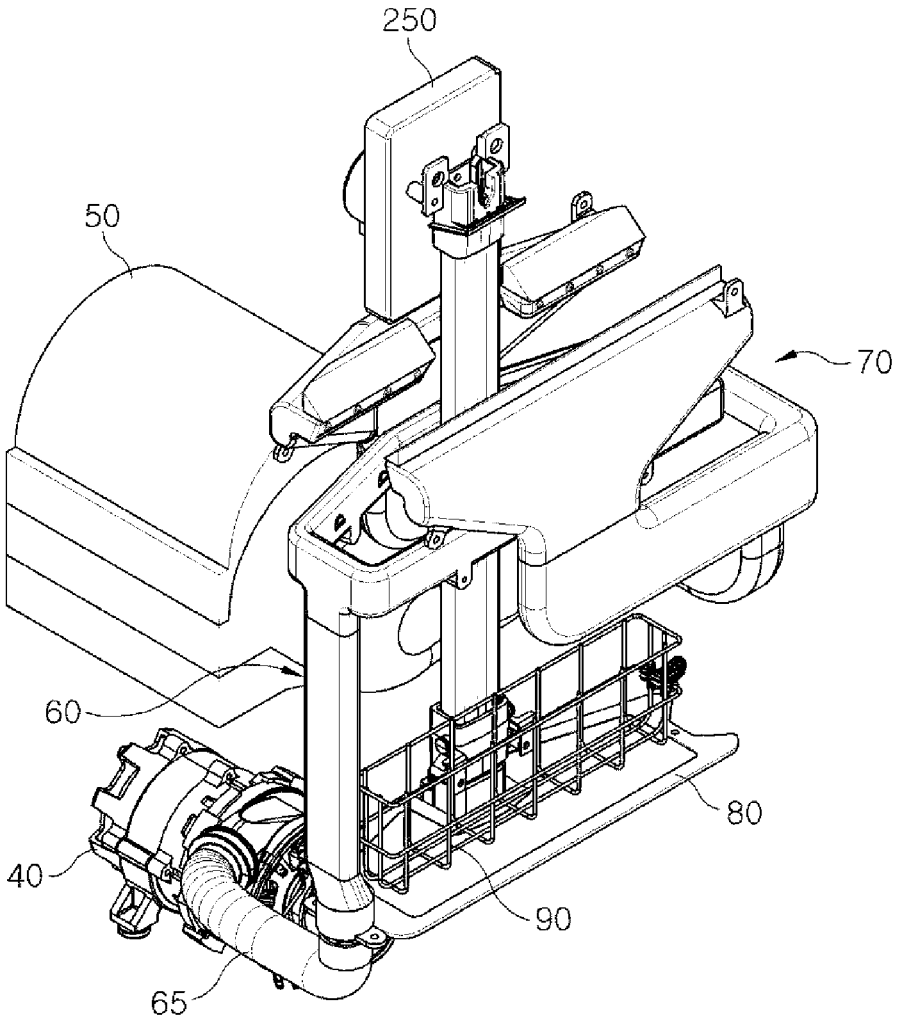
FIG. 4B is a perspective view illustrating a state in which the basket is located below while the washing tub of the dishwasher in accordance with an embodiment of the present disclosure is removed.

The basket 90 may be supported by one side of the driving device 100 and may be guided on a rail 140 of the driving device 100 to reciprocate in a vertical direction of the body 10. That is, the basket 90 may be provided below the driving device 100 as shown in FIG. 4B.

Figure 6A:
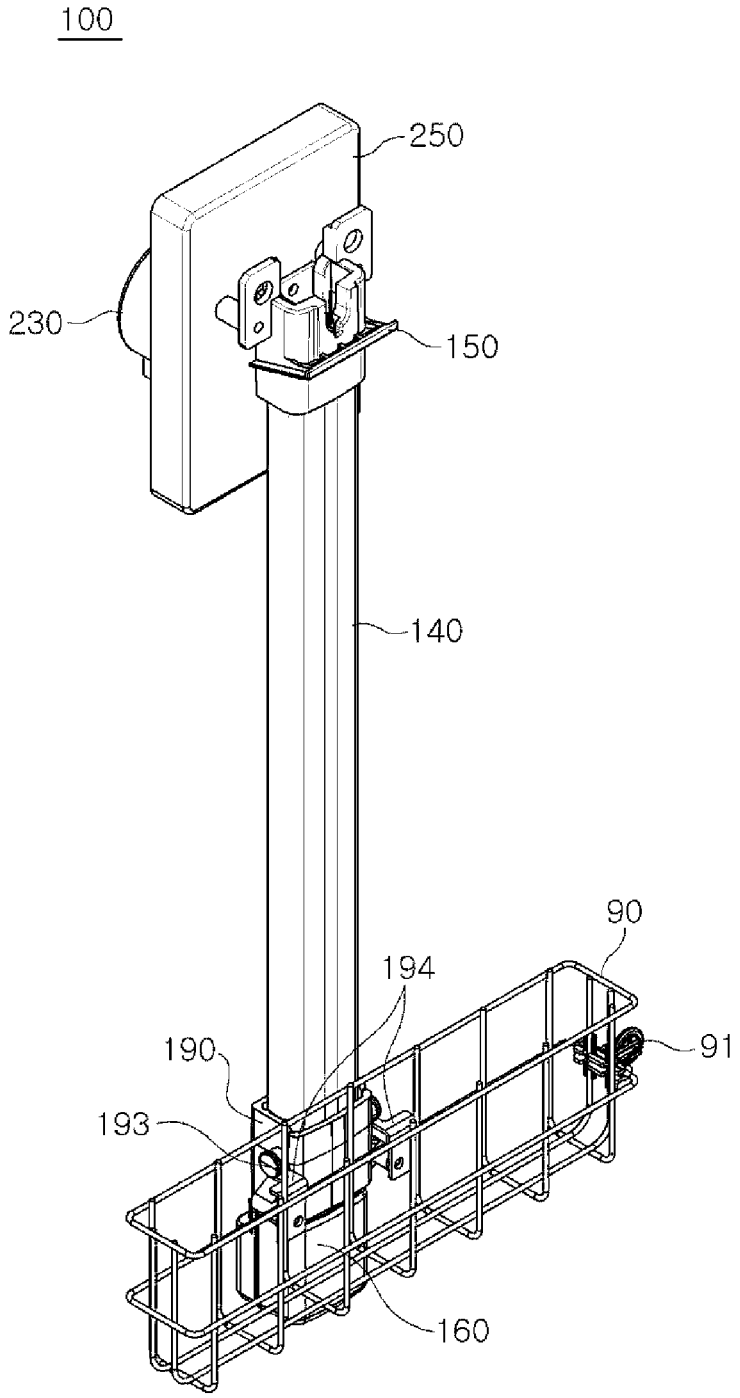
FIG. 6A is a view illustrating a driving device and the basket in accordance with an embodiment of the present disclosure.
Figure 6B:
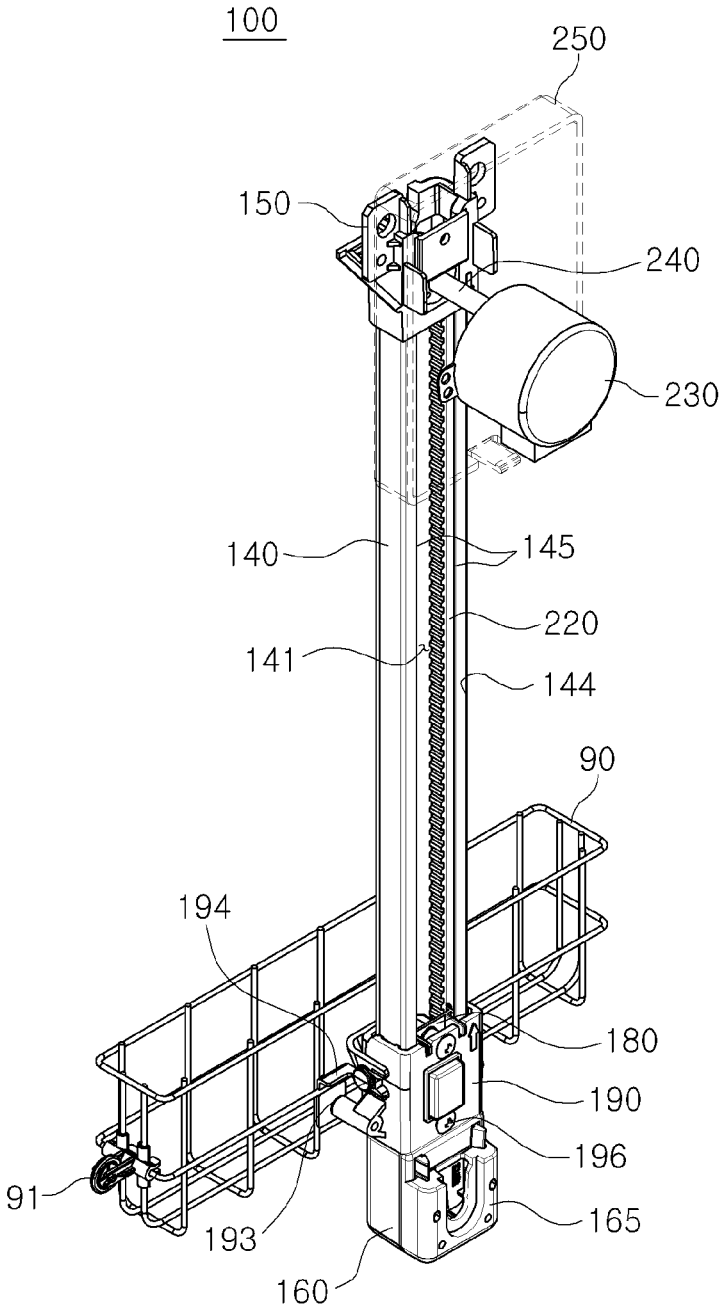
FIG. 6B is a view illustrating the driving device and the basket in accordance with an embodiment of the present disclosure.
Figure 7:
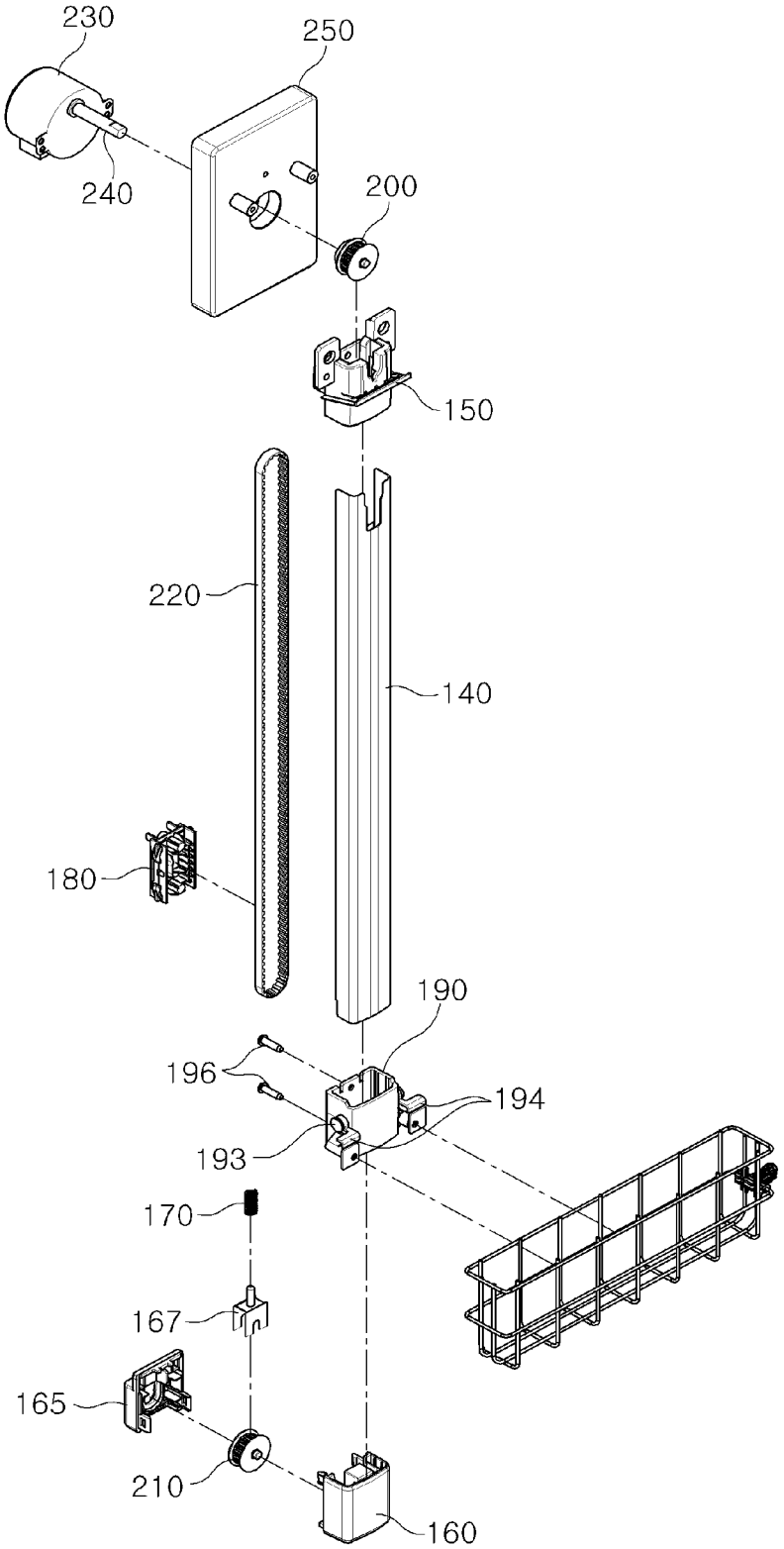
FIG. 7 is an exploded perspective view illustrating the driving device and the basket in accordance with an embodiment of the present disclosure.

The driving device 100 may be provided in the vertical direction of the body 10 which extends in a longitudinal direction. As shown in FIG. 6, the driving device 100 may include a basket holder 190 provided to be slidable on the rail 140.

Protrusions 193 for supporting the basket 90 may be provided on both sides of the basket holder 190, and hook members 194 coupled to the basket 90 may be coupled to the protrusions 193 corresponding thereto. The hook members 194 may be coupled to one side of the basket 90 to allow the basket 90 to vertically slide together with the basket holder 190.

A roller member 91 helps move the basket 90 upward while being in contact with the sidewall 33 of the washing tub 30 may be included at one side of the basket 90. The basket 90 may move upward and maintain a predetermined gap with the washing tub 30 through the roller member 91 and reciprocate while safely accommodating the dishes.

A movement route of the basket 90 may be provided via the injection nozzle 60 and the air nozzle 70. That is, at least a part of the driving device 100 may be provided corresponding to the injection nozzle 60 and the air nozzle 70. The washing operation and the driving operation may be performed while the dishes accommodated in the basket 90 pass through the injection nozzle 60 and the air nozzle 70.

During the washing operation, as described above, the injection nozzle 60 may inject the washing water and the injected washing water may hit the dishes to remove the waste thereon.

The injection nozzle 60 may include a connection pipe 63 which receives the washing water from the supply hose 65 and an injection nozzle arm 61 which receives the washing water from the connection pipe 63 and injects the washing water through the injection holes 62.

The supply hose 65 may receive the washing water pumped by the pump 40 provided outside the washing tub 30 and may supply the washing water to the inside of the washing tub 30.

The connection pipe 63 may be provided in the vertical direction of the washing tub 30 to supply the washing water to the injection nozzle arm 61 provided approximately in a center of the washing tub 30.

The injection nozzle arm 61 may include a plurality of such injection holes 62 and may inject the washing water to the dishes. A pair of such injection nozzle arms 61 may be provided corresponding to each other and may be disposed at a predetermined interval parallel to each other to allow the injection holes 62 provided in each of the pair of injection nozzle arms 61 to face one another.

One of the two injection nozzle arms 61 may be provided adjacent to the front wall 31, and the other may be provided adjacent to the rear wall 32.

The pair of injection nozzle arms 61 may be provided while having a bracket shape due to a connection portion which connects the respective injection nozzle arms 61. The washing water may be transferred to the respective injection nozzle arms 61 and be injected.

The driving device 100 may be provided in a gap provided between the pair of the injection nozzle arms 61. Because the pair of injection nozzle arms 61 faces each other, all the waste which remains on front and rear surfaces of the dishes may be washed away.

In the case of the injection nozzle arm 61 adjacent to the rear wall 32, because the driving device 100 is provided between the injection nozzle arms 61 and the basket 90, the washing water injected by the injection nozzle arm 61 which faces the driving device 100 may not arrive at the dishes.

Accordingly, a part of the injection nozzle arm 61 adjacent to the rear wall 32 is formed while including a curved surface to allow the injection holes 62 to be provided along the curved surface. Through the curved surface, an angle of injecting the washing water is adjusted to allow the washing water to arrive even at parts of the dishes which face the driving device 100.

Figure 5A:
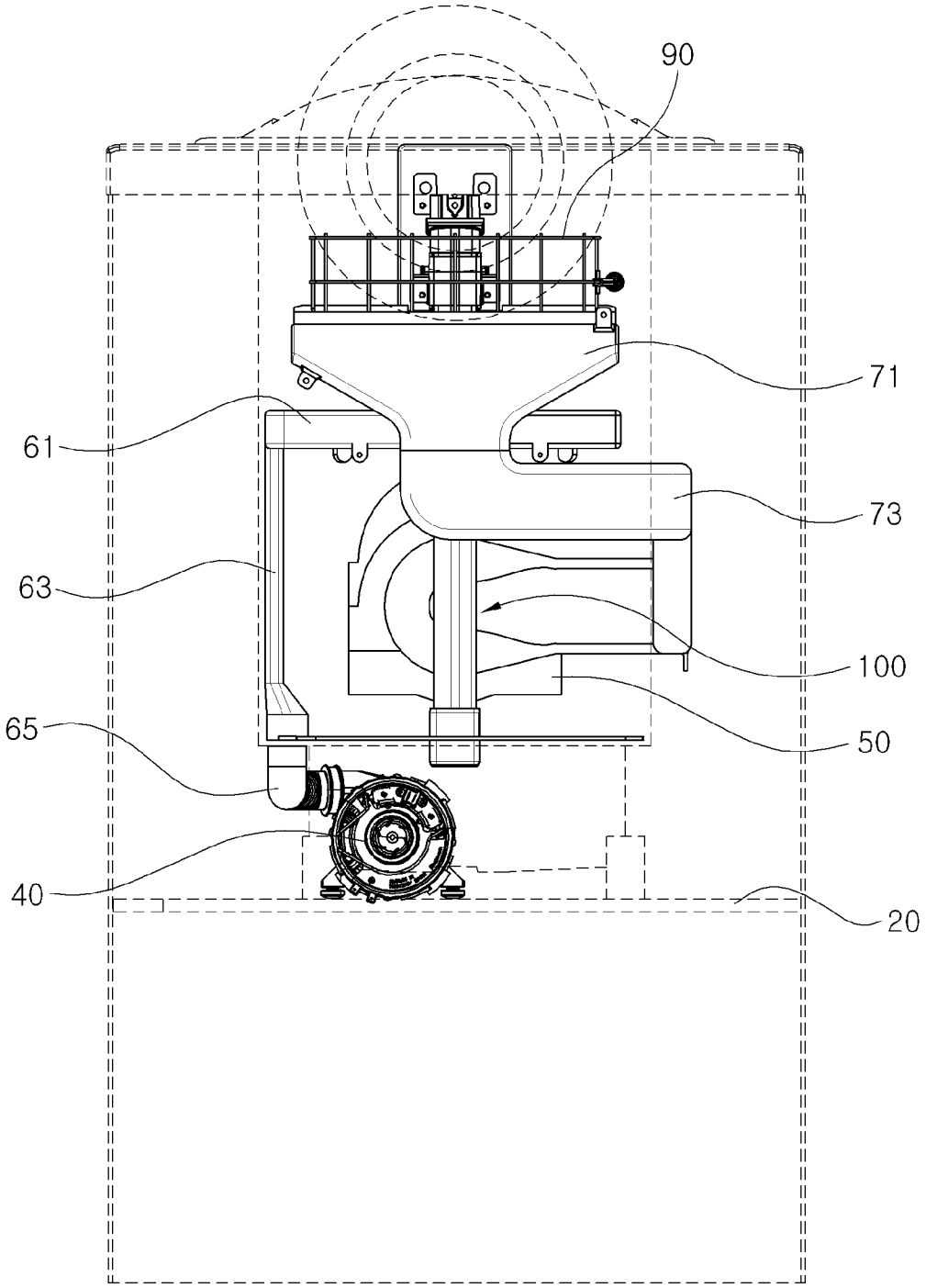
FIG. 5A is a front view illustrating a state in which the basket is located above while the washing tub of the dishwasher in accordance with an embodiment of the present disclosure is removed.
Figure 5B:
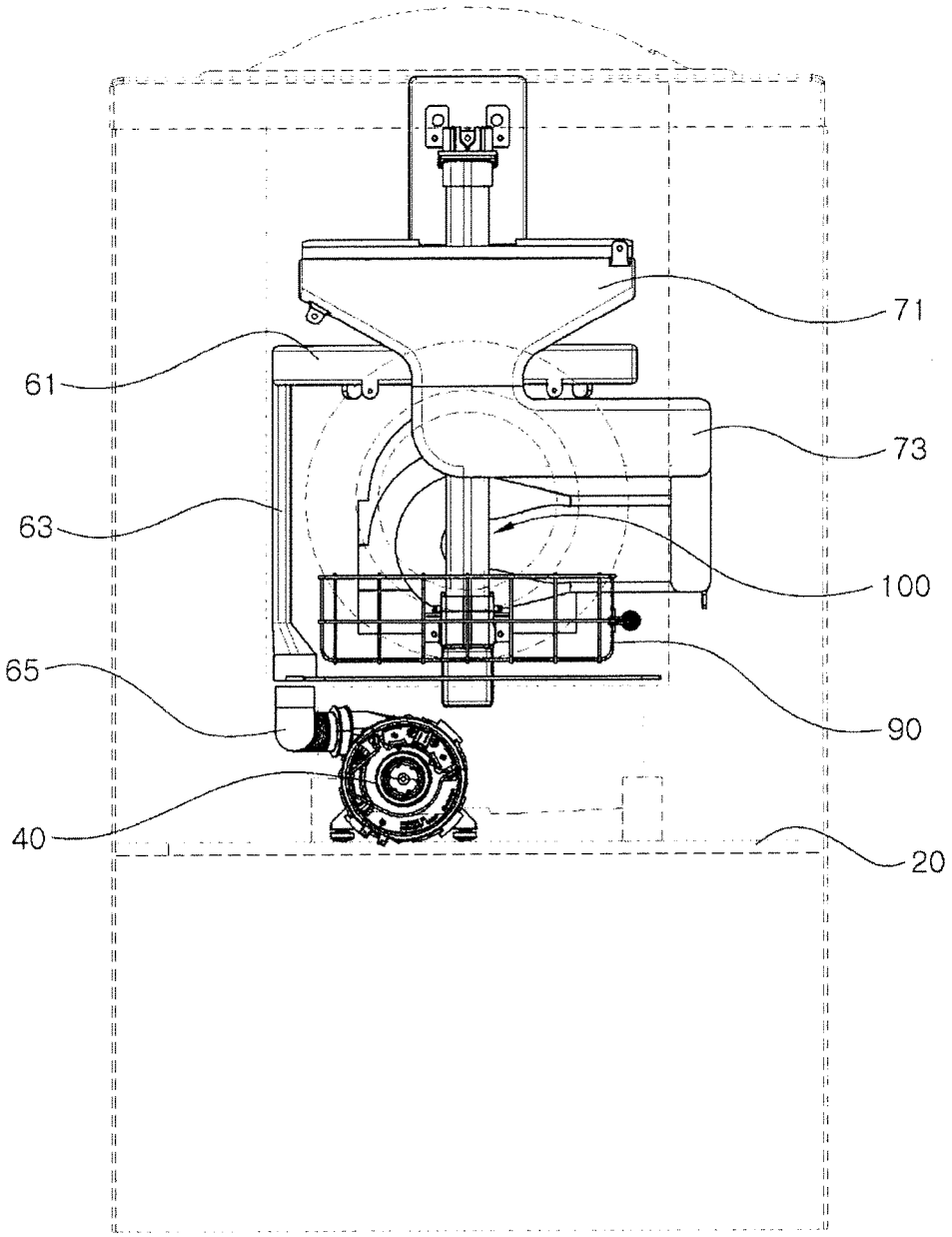
FIG. 5B is a front view illustrating the state in which the basket is located below while the washing tub of the dishwasher in accordance with an embodiment of the present disclosure is removed.

During the washing operation, the injection nozzle 60 may inject the washing water and the basket 90 provided above the driving device 100 may move to a bottom of the driving device 100 due to the driving device 100 (from a position shown in FIG. 5A to a position shown in FIG. 5B).

Here, the basket 90 may pass between the pair of injection nozzle arms 61 while moving down, and the dishes accommodated in the basket 90 may be washed by the washing water injected by the injection nozzle arms 61.

The washing operation may be performed through only one downward movement of the basket 90 as necessary, or may be performed through one or a plurality of times of reciprocating movements of the basket 90.

That is, the injection nozzle 60 may be driven until the basket 90 moves to the bottom of the driving device 100, and may be driven to inject the washing water until the basket 90 moves down and then moves upward again to be located on a top end of the driving device 100.

That is, depending on a setting value of the user, a driving range of the injection nozzle 60 may be determined by a controller (not shown).

For example, the controller may include a component which senses a rotation direction of a motor 230 and may control driving of the injection nozzle 60 according to a difference in the rotation direction of the motor 230.

In the position as shown in FIG. 5A, when the basket 90 moves down, the motor 230 rotates for the first time and a signal is sensed one time. When the basket 90 is located in a position as shown in FIG. 5B, because the basket 90 stops moving downward and moves upward again, the rotation direction of the motor 230 is changed and the signal may be sensed one more time.

When a setting value refers to the number of signals sensed at points in time when the rotation direction of the motor 230 is changed as described, an end point of the driving of the injection nozzle 60 may be set depending on the setting value.

When the setting value is 2 times, firstly, when rotation of the motor 230 starts, a value is sensed once and the injection nozzle 60 is driven. When the basket 90 is located at the bottom of the driving device 100 (in the position as shown in FIG. 5B), a value is sensed twice and the driving of the injection nozzle 60 is finished.

When the setting value is three times, a value is sensed three times when the basket 90 moves upward and is located at the top of the driving device 100 (in the position as shown in FIG. 5A) after being located at the bottom of the driving device 100 again, the driving of the injection nozzle 60 is finished.

Like this, when the setting value is five times, a value is sensed five times when the basket 90 is located at the top of the driving device 100 (in the position as shown in FIG. 5A) after reciprocating twice, the driving of the injection nozzle 60 may be finished.

After the washing operation is finished, the drying operation may be performed to remove moisture which remains on the dishes.

The air nozzle 70, as described above, may include the supply pipe 73 which receives the high pressure air from the air blower 50 and the air nozzle arm 71 which receives the air from the supply pipe 73 and injects the air through the air injection holes 72.

The air nozzle arm 71 may include a plurality of such air injection holes 72, and may inject the high pressure air to the dishes. A pair of such air nozzle arms 71 may be provided corresponding to each other and may be disposed at a predetermined interval parallel to each other to allow the air injection holes 72 provided in each of the pair of air nozzle arms 71 to face one another.

That is, one of the two air nozzle arms 71 may be provided adjacent to the front wall 31, and the other may be provided adjacent to the rear wall 32.

The driving device 100 may be provided in a gap provided between the pair of the air nozzle arms 71. Because the pair of air nozzle arms 71 faces each other, all the moisture which remains on front and rear surfaces of the dishes may be removed.

As described above, the air nozzle 70 may hit the dishes with the high pressure air to remove the moisture from the dishes using a physical effect. Accordingly, when another component is provided between the air injection holes 72 and the dishes, the air may not be transferred to the dishes and the dishes may not be dried.

Accordingly, because a part of the air nozzle arm 71 adjacent to the rear wall 32 may not inject the air to the dishes due to the driving device 100, the air injection hole 72 may not be located on a side corresponding to the driving device 100 in such a way that the pair of air nozzle arms 71 may be asymmetrically provided parallel to each other.

The drying operation may start after the washing operation is finished. The air nozzle 70 may inject the air and then may move upward or downward from a position at which the basket 90 is located when the washing operation is finished. Here, when the washing operation is finished at the position shown in FIG. 5A, the air nozzle 70 may move downward to the position shown in FIG. 5B. Otherwise, when the washing operation is finished at the position shown in FIG. 5B, the air nozzle 70 may move upward to the position shown in FIG. 5A.

Here, the basket 90 may move and pass between the pair of air nozzle arms 71 and the dishes stored in the basket 90 may be dried by the air injected by the air nozzle arms 71.

The drying operation, like the washing operation described above, may be performed through only one movement of the basket 90 as necessary, or may be performed through one or a plurality of times of reciprocating movements of the basket 90.

That is, the air nozzle 70 may be driven only until the basket 90 on the driving device 100 moves upward or downward once, and may be driven to inject the air until the basket 90 finishes the reciprocating movement.

That is, in addition to the setting value of the washing operation described above, the user may determine a setting value of the drying operation, and accordingly a driving range of the air nozzle 70 may be determined by the controller.

Because a method of controlling the drying operation is identical to the method of controlling the washing operation described above, a description thereof will be omitted. However, because the drying operation may start at the bottom of the driving device 100 (FIG. 5B) or at the top (FIG. 5A) depending on the setting value of the washing operation, there is a difference between the drying operation and the washing operation which starts only at the top of the driving device 100.

Hereinafter, the driving device 100 which allows the basket 90 in accordance with an embodiment of the present disclosure to move will be described in detail.

As shown in FIGS. 6A to 10, the driving device 100 includes the rail 140 which guides the movement of the basket 90 and has an internal space 141, a driving pulley 200 which is connected to the motor 230 and rotates, a belt 220 which is connected to the driving pulley 200 to rotate and disposed in the internal space 141 of the rail 140, an idle pulley 210 connected to the belt 220 to support the belt 220 to be rotatable, a belt holder 180 disposed in the internal space 141 of the rail 140 to be coupled to the belt 220 and to linearly reciprocate, a basket holder 190 disposed outside the rail 140 to be coupled to the belt holder 180 to linearly reciprocate and to be coupled to the basket 90, an upper holder 150 which supports the driving pulley 200 to be rotatable and is coupled to a rear end of the rail 140, and a lower holder 160 which supports the idle pulley 210 to be rotatable and is coupled to a front end of the rail 140.

The rail 140 may be formed of a metal material. The rail 140 may be provided to extend in a vertical direction of the rear wall 32 of the washing tub 30.

The rail 140 may have a pipe shape which includes a rear opening 145 formed approximately at a rear side. That is, the rail 140 may include the internal space 141 and the rear opening 145 formed in a rear wall 144. The rear opening 145 may extend from one end to the other end of the rail 140 in a longitudinal direction thereof.

A reason for providing the rail 140 formed in the pipe shape as described above is to allow the belt 220 to be disposed in the internal space 141 of the rail 140, thereby preventing the belt 220 from coming in contact with and being hindered by the dishes of the washing tub 30 or from coming in contact with the washing water of the washing tub 30 and being corroded.

Also, a reason for forming the opening 145 in the rear wall 144 of the rail 140 is to connect the belt 220 disposed in the internal space 141 of the rail 140 with the driving device 100 provided outside the rail 140. Accordingly, a driving force of the belt 220 may be transferred to the driving device 100.

The belt 220 may be wound on the driving pulley 200 and the idle pulley 210, may form a closed curve, and may rotate in the rotation direction of the motor 230 when the motor 230 is driven. The belt 220, considering tensile strength and costs, may be formed of a resin material which includes aramid fiber.

A tooth form 221 which transfers the driving force of the belt 220 to the belt holder 180 may be formed at an inner surface of the belt 220.

Figure 8:
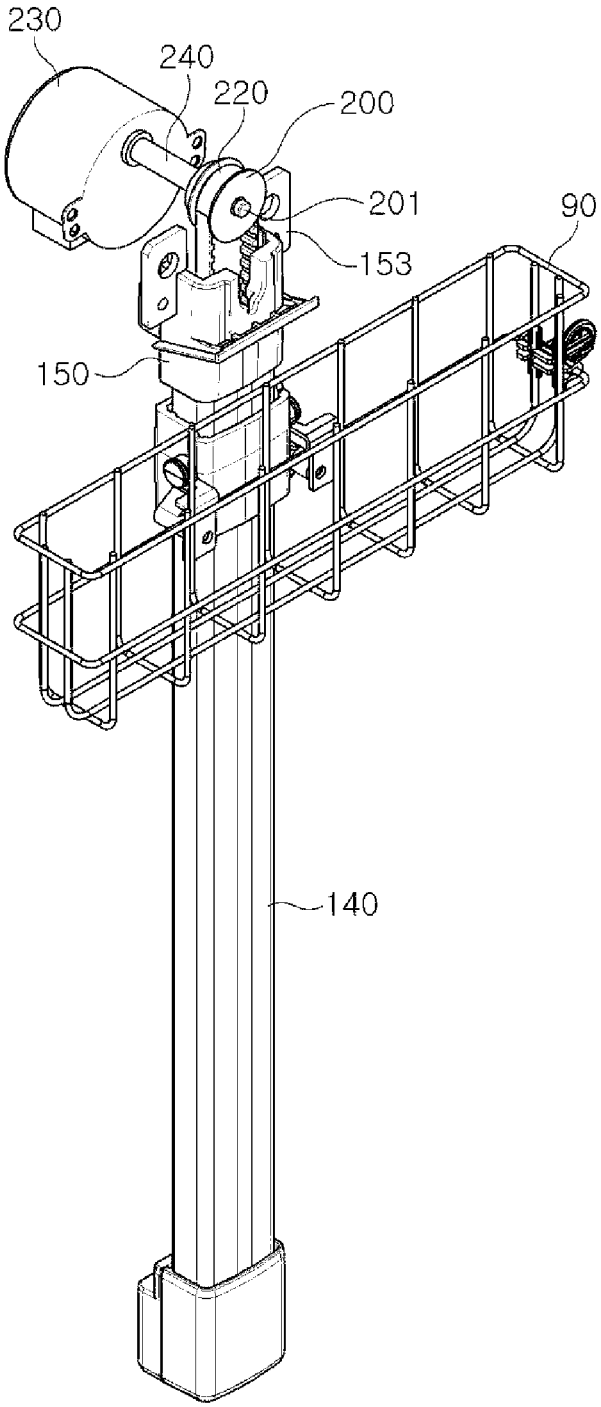
FIG. 8 is a view illustrating components of the driving device in accordance with an embodiment of the present disclosure.

As shown in FIG. 8, the belt holder 180, like the belt 220, may be disposed in the internal space 141 of the rail 140 and may move together with the belt 220 while being coupled to the tooth form 221 of the belt 220. For this, the belt holder 180 may include a tooth form coupling portion 181 coupled to the tooth form 221 of the belt 220.

Also, the belt holder 180 may include legs 182 and 183 supported by the rail 140. The legs 182 and 183 may include one or more lateral legs 182 which laterally protrude and are supported by a side portion of the rail 140 and one or more lower legs 183 which protrude rearward and are supported by the rail 140.

The lateral legs 182 may be elastically deformable to reduce noise and vibrations caused by collision and friction with the rail 140 and to allow the belt holder 180 to smoothly move while the belt holder 180 is moving.

The lateral legs 182 may be a kind of a plate spring type elastic body. That is, the lateral legs 182 may include curved plates which are elastically deformed between a relaxed shape and a compressed shape.

Also, the belt holder 180 may include a fastening portion 184 for coupling with the basket holder 190. The fastening portion 184 may include a fastening hole (not shown) into which a fastening member 196 is inserted.

The basket holder 190 is coupled to the belt holder 180, moves together with the belt holder 180, and transfers a driving force of the belt holder 180 to the basket 90. The basket holder 190 is provided to surround an outer surface of the rail 140.

The basket holder 190 is coupled to the belt holder 180 through the rear opening 145 of the rail 140. Also, the basket holder 190 may include the protrusions 193 with which the basket 90 is separably coupled.

The driving pulley 200 includes a rotation axis 201 and a shaft connection portion (not shown) provided on the rotation axis 201 to be connected to a driving shaft 240 to receive a driving force, and is coupled to the belt 220 therein to be driven.

Figure 9:
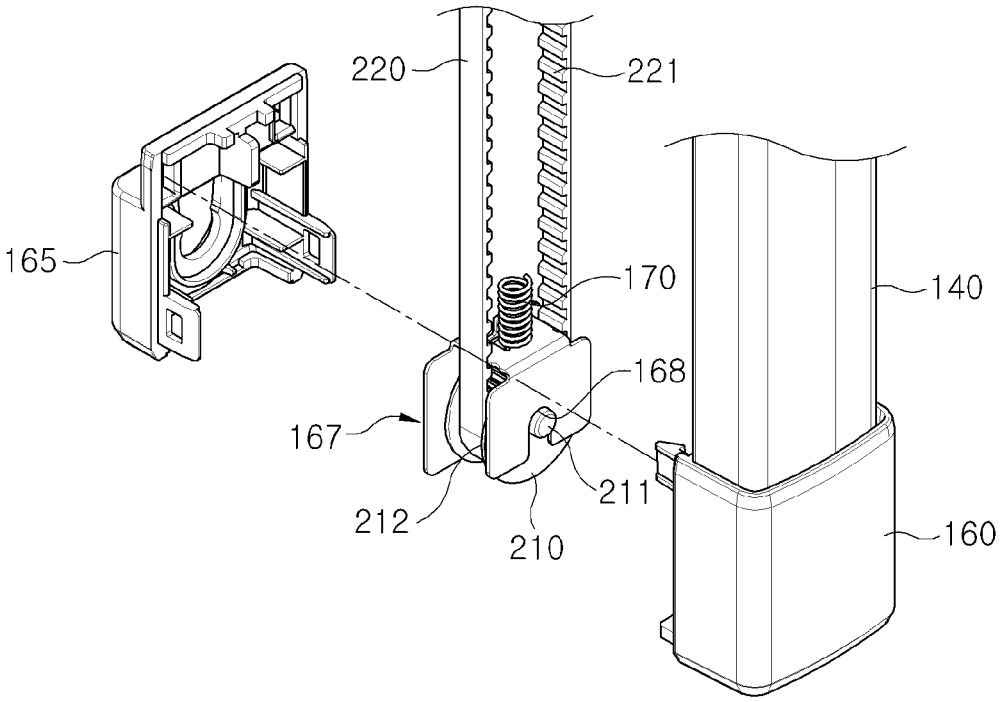
FIG. 9 is a view illustrating components of the driving device in accordance with an embodiment of the present disclosure.

As shown in FIG. 9, the upper holder 150 supports the driving pulley 200 to be rotatable, and is coupled to a rear end of the rail 140. In FIG. 8, for convenience of description, it is shown that the driving pulley 200 and the belt 220 located in the upper holder 150 are located above.

The upper holder 150 supports the rotation axis 201 of the driving pulley 200 inward and supports the rear end of the rail 140. Also, the upper holder 150 includes a fastening hole 153 to be coupled to a motor housing 250.

Figure 10:
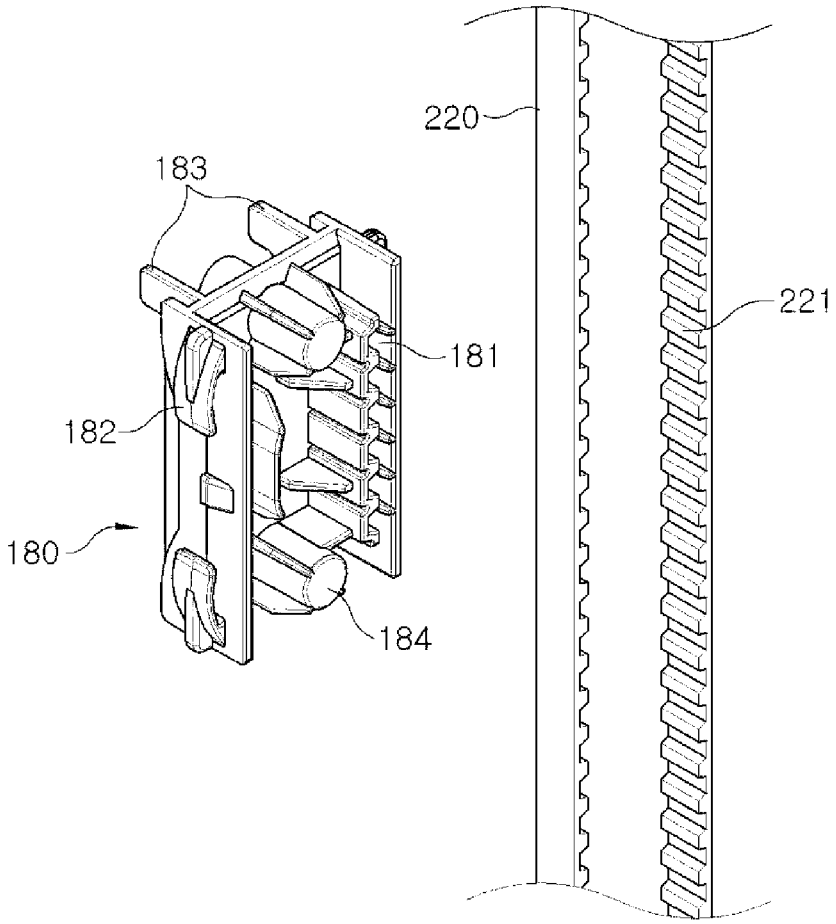
FIG. 10 is a view illustrating components of the driving device in accordance with an embodiment of the present disclosure.

As shown in FIG. 10, the lower holder 160 includes a lower rearward holder 165 coupled to the lower holder 160, and a pulley bracket 167 provided to be movable along a longitudinal direction of the rail 140 in the lower rearward holder 165 and to support the idle pulley 210 to be rotatable.

Also, the idle pulley 210 includes the rotation axis 201 and a belt coupling portion 212 with which the belt 220 is coupled.

The lower rearward holder 165 may be coupled to a rear side of the lower holder 160 through a holding structure. The pulley bracket 167 includes a pulley supporting surface 168 which supports a rotation axis 211 of the idle pulley 210.

Meanwhile, the rail 140, the belt 220, the driving pulley 200, the upper holder 150, the idle pulley 210, and the lower holder 260 may be assembled with one another by the tension of the belt 220.

That is, due to the tension of the belt 220, the driving pulley 200 is pressurized in a direction in which it becomes closer to the rail 140, force is transferred to the upper holder 150, and as a result, the upper holder 150 is in close contact with and coupled to a bottom end of the rail 140.

Also, due to the tension of the belt 220, the idle pulley 210 is pressurized in a direction in which it becomes closer to the rail 140. The force is transferred to the lower holder 160. As a result, the lower holder 160 is in close contact with and coupled to a top end of the rail 140.

Meanwhile, the lower holder 160 may further include an elastic member 170 for maintaining the tension of the belt 220. When the belt 220 thermally expands due to heat inside the washing tub 30, the belt 220 stretches and the tension of the belt 220 is reduced. When the tension of the belt 220 is reduced, the driving device 100 is not able to be smoothly driven.

Because the pulley bracket 167 is pressurized in the direction in which it becomes closer to the rail 140 due to the tension of the belt 220, the pulley bracket 167 is allowed to move to a position at which the tension of the belt 220 and the elastic force of the elastic member 170 are balanced.

That is, when the belt 220 stretches and decreases in tension and the elastic force of the elastic member 170 becomes greater than the tension of the belt 220, the pulley bracket 167 moves in a direction in which it becomes farther from the rail 140 due to the elastic force of the elastic member 170. As described above, when the pulley bracket 167 moves in the direction in which it becomes farther from the rail 140, the belt 220 is pulled taut again and the tension of the belt 220 is restored.

Due to this configuration, even when the belt 220 stretches due to thermal expansion, the pulley bracket 167 moves and pulls the belt 220, thereby maintaining the constant tension of the belt 220.

As is apparent from the above description, a dishwasher in accordance with an embodiment of the present disclosure is appropriately provided to wash a small amount of the dishes to reduce a washing time and energy.

The detailed description in the above exemplifies the present disclosure. Also, the contents described above allow exemplary embodiments of the present disclosure to be illustrated, and the present disclosure may be used in various different combinations, modifications, and environments. That is, within the scope of the present disclosure disclosed in the present specification, the scope of the equivalents to the disclosed above and/or the ordinary skill or knowledge in the art, changes or modifications may be performed. The embodiments described above are used to describe optimal statuses to embody the technical concept of the present disclosure and are variously changeable if necessary in detailed application fields or use thereof. Accordingly, the detailed description does not intend to limit the present disclosure to the embodiments described above. Also, the following claims should be understood as including other embodiments.

Although a few embodiments of the present disclosure have been shown and described, it should be appreciated by those skilled in the art that changes may be made in these embodiments without departing from the principles and spirit of the disclosure, the scope of which is defined in the claims and their equivalents.

What is claimed is:

1. A dishwasher comprising:

a body including an opening provided in a top of the body;

a washing tub provided inside the body of the dishwasher;

a basket provided in the washing tub and below the opening, and configured to accommodate a dish received through the opening;

an injection nozzle provided in the washing tub and below the opening, and configured to spray washing water toward the basket, and including a plurality of injection nozzle arms including injection holes through which the washing water is sprayed, in which a pair of the plurality of injection nozzle arms is disposed at a predetermined interval to be parallel to each other such that the injection holes face each other;

an air nozzle provided in the washing tub, below the opening, and above the injection nozzle, and configured to blow air toward the basket, and including a plurality of air injection nozzle arms including air injection holes through which the air is blown, in which a pair of the plurality of air injection nozzle arms is disposed at a predetermined interval to be parallel to each other such that the injection holes face each other; and a basket driver configured to linearly reciprocate the basket between the pair of the plurality of air injection nozzle arms and the pair of the plurality of air injection nozzle arms while at least one of the injection nozzle sprays the washing water and the air nozzle blows the air, wherein the injection nozzle is configured to spray the washing water toward both sides of the basket while the basket passes between the pair of the plurality of injection nozzle arms, and wherein the air nozzle is configured to blow air toward both sides of the basket while the basket passes between the pair of the plurality of air injection nozzle arms.

2. The dishwasher of claim 1, wherein the basket driver is provided between the pair of the plurality of injection nozzle arms and the pair of the plurality of air injection nozzle arms, and is configured to be elongated in a vertical direction of the body.

3. The dishwasher of claim 2, wherein the basket is supported by a top end of the basket driver and reciprocates to a bottom end of the basket driver while being connected to the basket driver.

4. The dishwasher of claim 3, wherein the basket moves downward to the bottom end of the basket driver while the injection nozzle sprays the washing water.

5. The dishwasher of claim 3, wherein the basket moves upward from the bottom end of the basket driver to the top end of the basket driver while the air nozzle blows the air.

6. The dishwasher of claim 1, wherein the basket reciprocates at least once while being connected to the basket driver while the injection nozzle sprays the washing water.

7. The dishwasher of claim 1, wherein the basket reciprocates at least once while being connected to the basket driver while the air nozzle blows the air.

8. The dishwasher of claim 1, wherein the air nozzle blows the air to pressurize and remove moisture on a surface of the dish using air pressure.

9. The dishwasher of claim 8, wherein an air blower configured to supply the air to the air nozzle is provided in the body.

10. The dishwasher of claim 9, wherein the air nozzle comprises a supply pipe provided to receive the air supplied by the air blower, and wherein one or more bent portions are provided in a part of the supply pipe to be adjacent to an outside of the washing tub.

11. The dishwasher of claim 1, wherein the basket driver comprises:

a motor configured to generate a driving force;

a belt connected to a driving pulley and an idle pulley and configured to rotate to transfer the driving force of the motor to the basket; and a rail configured to guide a movement of the basket.

12. The dishwasher of claim 11, wherein the rail has a pipe shape which has an internal space and an opening at one side thereof.

13. The dishwasher of claim 12, wherein the belt is disposed in the internal space of the rail, and wherein the basket driver further comprises a belt holder coupled to a tooth form of the belt and configured to move together with the belt in the internal space of the rail.

14. The dishwasher of claim 13, wherein the basket driver further comprises a basket holder provided to surround an outer surface of the rail, is configured to move together with the belt holder while being coupled to the belt holder through the opening of the rail, and is coupled to the basket.

15. A dishwasher comprising:

a body including an opening provided in a top of the body;

a washing tub provided inside the body of the dishwasher;

a basket provided in the washing tub and below the opening, and provided to accommodate a dish received through the opening;

an injection nozzle provided in the washing tub and below the opening, and configured to spray washing water toward the basket and including a pair of injection nozzle arms disposed at a predetermined interval to be parallel to each other; and a basket driver configured to drive the basket to pass by the injection nozzle and linearly reciprocate while the injection nozzle sprays the washing water toward the basket such that the dish in the basket is washed, wherein the injection nozzle is configured to spray washing water toward both sides of the basket while the basket passes between the pair of injection nozzle arms.

16. The dishwasher of claim 15, wherein an opening is provided at one side of the washing tub such that the dish is insertable into the opening, and wherein the dish is inserted into the opening, is accommodated in the basket, and is moved to the other side of the washing tub while the injection nozzle is operated to wash the dish.

17. The dishwasher of claim 16, further comprising an air nozzle configured to blow air to remove moisture on a surface of the dish using air pressure, and wherein the basket is returned toward the opening of the washing tub while the air nozzle is operated to dry the dish.

18. A dishwasher comprising:

a body including an opening provided in a top of the body;

a washing tub provided inside the body of the dishwasher;

an injection nozzle provided in the washing tub and below the opening, and configured to spray washing water toward a dish received through the opening;

an air nozzle provided in the washing tub, below the opening, and above the injection nozzle, and configured to blow air toward the dish;

a basket configured to accommodate the dish and to linearly reciprocate by the injection nozzle and the air nozzle; and a motor configured to drive the reciprocation of the basket while at least one of the injection nozzle sprays the washing water and the air nozzle blows the air, wherein the injection nozzle is configured to spray the washing water toward the basket while the basket passes the injection nozzle, and wherein the air nozzle is configured to blow air toward the basket while the basket passes the air nozzle.

* * * * *